US006488740B1

(12) United States Patent
Patel et al.

(10) Patent No.: US 6,488,740 B1
(45) Date of Patent: Dec. 3, 2002

(54) APPARATUS AND METHOD FOR DECREASING CONTAMINANTS PRESENT IN A FLUE GAS STREAM

(75) Inventors: Dan V. Patel, Birmingham, AL (US); Alfred L. Hester, Birmingham, AL (US); David W. Morris, Chelsea, AL (US)

(73) Assignee: Electric Power Research Institute, Inc., Palo Alto, CA (US)

( * ) Notice: Subject to any disclaimer, the term of this patent is extended or adjusted under 35 U.S.C. 154(b) by 0 days.

(21) Appl. No.: 09/797,262

(22) Filed: Feb. 28, 2001

Related U.S. Application Data

(60) Provisional application No. 60/185,999, filed on Mar. 1, 2000, and provisional application No. 60/185,998, filed on Mar. 1, 2000.

(51) Int. Cl.[7] ..... B03C 3/014

(52) U.S. Cl. ..... 95/71; 95/73; 95/75; 96/32; 96/44; 96/47; 96/50; 96/53

(58) Field of Search ..... 95/64, 65, 66, 95/75, 71, 72, 76, 73; 96/44, 47, 50, 52, 53, 32

(56) References Cited

U.S. PATENT DOCUMENTS

| | | | | | |
|---|---|---|---|---|---|
| 1,382,037 | A | * | 6/1921 | Welch | 95/75 X |
| 1,766,422 | A | * | 6/1930 | Wintermute et al. | 95/75 |
| 2,874,802 | A | | 2/1959 | Gustafsson et al. | 95/71 |
| 3,444,668 | A | | 5/1969 | Masuda | 55/421 X |
| 3,797,204 | A | | 3/1974 | Cavatassi | 261/116 X |
| 3,958,960 | A | | 5/1976 | Bakke | 96/47 |
| 3,958,961 | A | | 5/1976 | Bakke | 261/117 X |
| 3,960,687 | A | * | 6/1976 | Bakke et al. | 95/75 X |
| 4,072,477 | A | | 2/1978 | Hanson et al. | 55/DIG. 38 |
| 4,074,983 | A | | 2/1978 | Bakke | 96/48 |
| 4,134,741 | A | * | 1/1979 | Elsbernd et al. | 95/75 |
| 4,364,910 | A | * | 12/1982 | Willett et al. | 95/66 X |
| 4,530,822 | A | * | 7/1985 | Ashley et al. | 95/66 X |
| 4,885,139 | A | * | 12/1989 | Sparks et al. | 95/65 X |
| 5,137,546 | A | * | 8/1992 | Steinbacher et al. | 96/52 X |
| 5,282,885 | A | * | 2/1994 | Cameron | 96/53 X |
| 5,547,496 | A | | 8/1996 | Hara | 96/79 |
| 5,601,791 | A | * | 2/1997 | Plaks et al. | 95/65 X |
| 5,624,476 | A | * | 4/1997 | Eyraud | 96/53 X |
| 6,117,403 | A | * | 9/2000 | Alix et al. | 96/53 X |
| 6,302,945 | B1 | * | 10/2001 | Altman et al. | 96/44 |

FOREIGN PATENT DOCUMENTS

| | | | | |
|---|---|---|---|---|
| CA | 726116 | * | 1/1966 | 95/75 |

OTHER PUBLICATIONS

Masuda et al., "Hybrid–Type Electrostatic Precipitator", Paper No. 76–42.1, undated pp. 2–14, Univ. of Tokyo.

Patel et al., "Water Treatment for Wet Electrostatic Precipitators", EPRI Licensed Material, ® 1997, pp. i—D–13.

* cited by examiner

*Primary Examiner*—Richard L. Chiesa
(74) *Attorney, Agent, or Firm*—Pennie & Edmonds LLP

(57) ABSTRACT

The apparatus includes a wet electrostatic precipitator (ESP) field disposed along a combusted fossil-fuel flue gas stream path downstream of a dry ESP field. The wet ESP field includes a chamber having a flue gas inlet and a flue gas outlet, and at least one collection plate positioned within the chamber. The chamber also includes one or more wash nozzle positioned adjacent the collection plate, and a wet hopper positioned substantially under the collection plate. The apparatus preferably further includes one or more cooling nozzles positioned near the flue gas inlet. The cooling and wash nozzles are fluidly coupled to a water source, while the wet hopper is fluidly coupled to either a pH adjustment module or a treatment processor. A method of removing contaminants from a flue gas stream using the above apparatus is also disclosed.

38 Claims, 6 Drawing Sheets

APPARATUS AND METHOD FOR DECREASING CONTAMINANTS PRESENT IN A FLUE GAS STREAM

This application claims priority to Provisional Application Serial No. 60/185,999 filed Mar. 1, 2000 entitled, "Hybrid ESP Once-Through Cycle and Provisional Application Serial No. 60/185,998 filed Mar. 1, 2000 entitled, "Hybrid ESP Closed-Loop Operation".

BRIEF DESCRIPTION OF THE INVENTION

This invention relates generally to the control of pollutants emitted from a combustion process. More particularly, this invention relates to an apparatus and method for decreasing the concentration of contaminants present in a flue gas stream emitted by a fossil-fuel fired boiler by using a hybrid electrostatic precipitator.

BACKGROUND OF THE INVENTION

The 1990 amendments to the United States Clean Air Act require major producers of air emissions, such as electrical power plants, to limit the discharge of airborne contaminants emitted from combustion processes. In most steam power plants in operation today, fossil fuels (such as petroleum or coal) are burned in a boiler to heat water into steam. The steam drives electrical turbines, which generate electricity. These fossil-fuel fired boilers, however, emit highly polluting flue gas streams into the atmosphere. These flue gas streams typically contain noxious gaseous chemical compounds, such as carbon dioxide, chlorine, fluorine, $NO_x$ and $SO_x$, as well as particulates, such as fly ash that is a largely incombustible residue that remains after incineration of the fossil-fuel.

To date, many devices have been used to reduce the concentration of contaminants emitted by fossil-fuel fired boilers. One of the most effective devices is the electrostatic precipitator or ESP. An ESP is a device with evenly spaced static conductors, typically plates, which are electrostatically charged. When flue gases are passed between the conductors, particulates in the flue gas become charged and are attracted to the conductors. Typically, twenty to sixty conductors are arranged parallel to one another, and the flue gas stream is passed through gas passages formed between the conductors. The particulate layer formed on the conductors limits the strength of the electrostatic field and reduces the performance of the ESP. To maintain performance, the conductors are periodically cleaned to remove the collected particulates.

There are two types of ESPs, dry and wet ESPs. A dry ESP removes particulates from the conductors, by shaking or rapping the conductors and collecting the removed particulates in a dry hopper. A wet ESP removes the particulates by washing the particulates off the conductors and collecting the removed particulates in a wet hopper.

Dry ESPs, however, have a number of shortfalls. First, when the conductors are rapped, some of the particulates are re-entrained in the flue gas stream. If the flue gas is vented to atmosphere after such a dry ESP field, any re-entrained particulates will vent into the atmosphere. Therefore, although dry ESPs are highly efficient, a certain amount of contaminants cannot be removed by the dry ESP. It has been shown through experimentation, that each field of a dry ESP can remove approximately 70% of the particulates entrained in a flue gas stream. Therefore, a number of dry ESP fields are typically arranged in series until a desired concentration of particulates is attained. An example of a dry ESP can be found in U.S. Pat. No. 5,547,496, which is incorporated herein by reference.

To date, wet ESPs have not been used in electric power stations. However, existing systems for removing particulates using a series of wet ESP fields are well known in the industrial sector. An example of a wet ESP is disclosed in U.S. Pat. Nos. 3,958,960 and 3,958,960, which are incorporated herein by reference. A problem with these systems is that the introduction of too much moisture into the flue gas leads to moisture saturation of the flue gas. This tends not to be a problem in industrial plants, as there is little or no gaseous chemical compounds present in the flue gas stream that can dissolve in the moisture to form acidic solutions. However, in combusted fossil-fuel flue gas, the saturated flue gas condenses and combines with the gaseous chemical compounds present in the flue gas to form highly corrosive acid solutions. To limit corrosion of the system by these acids, the system must be lined with acid inhibitors and include induced draft fans.

A system for removing particulates using a series of dry ESP fields and a wet ESP field is disclosed in U.S. Pat. No. 3,444,668, which is also incorporated herein by reference. This system removes particulates from a cement manufacturing process. This process does not address problems specific to fossil-fuel fired boiler emissions, such as removing contaminant gaseous chemical compounds present in a combusted fossil-fuel flue gas stream.

Furthermore, systems that position a wet ESP field upstream of a dry ESP field, such as that disclosed in U.S. Pat. No. 2,874,802, which is also incorporated herein by reference, do not sufficiently remove contaminants from a gas stream or address the above described problems.

In view of the foregoing, it would be highly desirable to provide an efficient system for decreasing the concentration of contaminants within a flue gas stream emitted by a fossil-fuel fired boiler, while addressing the above described shortfalls of prior art systems.

SUMMARY OF THE INVENTION

According to the invention there is provided an apparatus for decreasing the concentration of contaminants within a flue gas stream emitted by a fossil-fuel fired boiler. The apparatus includes a wet electrostatic precipitator (ESP) field disposed along a combusted fossil-fuel flue gas stream path downstream of a dry ESP field. The wet ESP field includes a chamber having a flue gas inlet and a flue gas outlet, and at least one collection plate positioned within the chamber. The chamber also includes one or more wash nozzle positioned adjacent to the collection plate and a wet hopper positioned substantially under the collection plate. The apparatus preferably further comprises one or more cooling nozzles positioned near the flue gas inlet. The cooling and wash nozzles are fluidly coupled to a water source, while the wet hopper is fluidly coupled to either a pH adjustment module or a treatment processor.

Further according to the invention there is provided a method of decreasing the concentration of contaminants within a flue gas stream emitted by a fossil-fuel fired boiler. Contaminants are electrostatically collected from a combusted fossil-fuel flue gas stream on dry and wet electrostatic precipitator (ESP) conductors, where the wet ESP conductor is disposed downstream of the first ESP conductor. The dry ESP conductor is then shaken to remove contaminants collected thereon, while the wet ESP conductor is washed to remove contaminants collected thereon. The wet ESP conductor is washed either continuously or intermittently, however, a continuous wash is preferred for ease of control.

To improve performance, water is preferably sprayed into the wet ESP inlet flue gas stream to lower the flue gas temperature. In one embodiment, the water sprayed into the flue gas stream to lower the temperature and used to wash the collection plates is acquired from an untreated water source. In another embodiment, the sprayed water is recirculated in a closed loop.

BRIEF DESCRIPTION OF THE DRAWINGS

For a better understanding of the invention, reference should be made to the following detailed description taken in conjunction with the accompanying drawings, in which.

Like reference numerals refer to corresponding parts throughout the drawings.

DETAILED DESCRIPTION OF THE INVENTION

Figure 1:
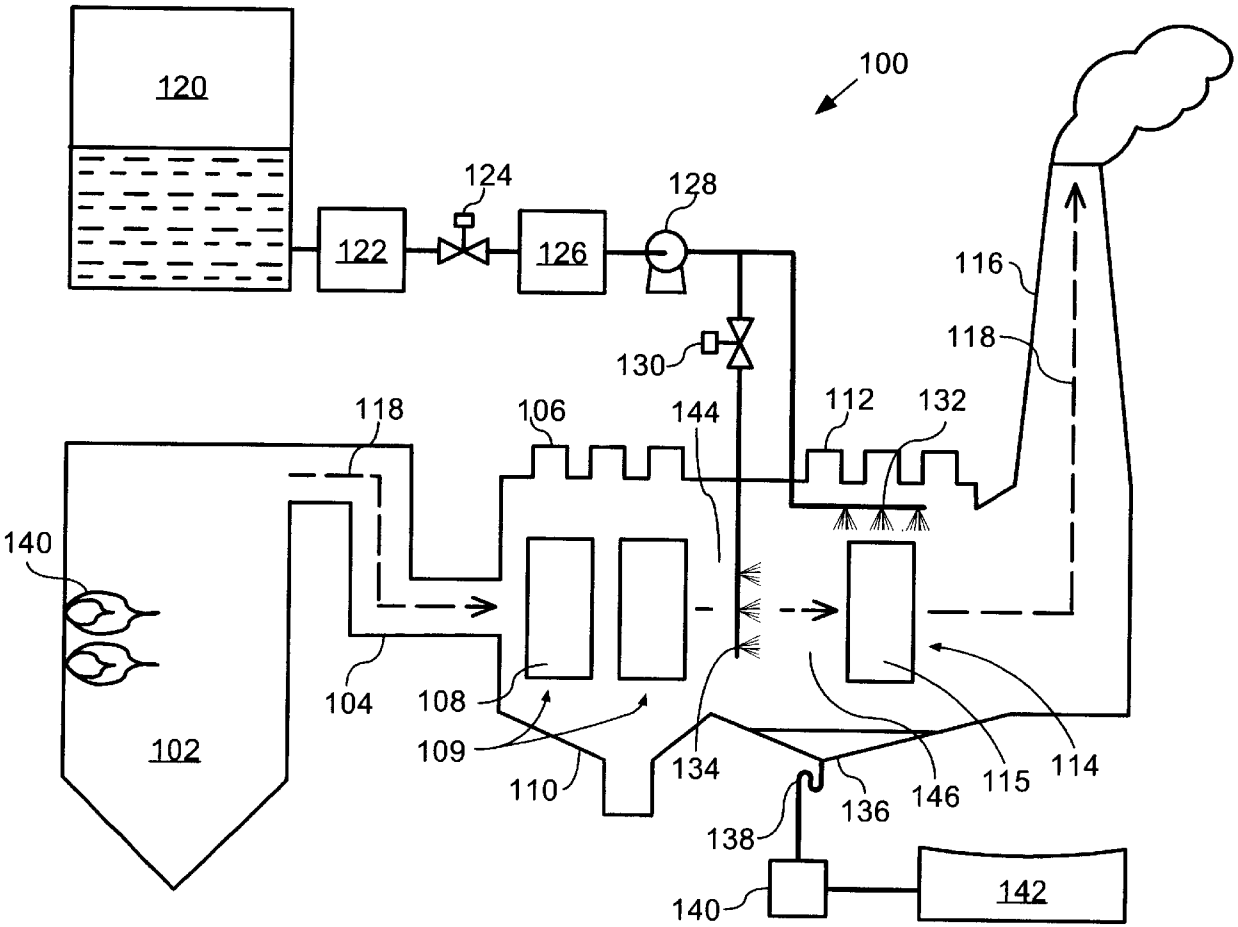
FIG. 1 is a diagrammatic view of a system for decreasing the concentration of contaminants within a flue gas stream emitted by a fossil-fuel fired boiler, according to an embodiment of the invention.
Figure 2:
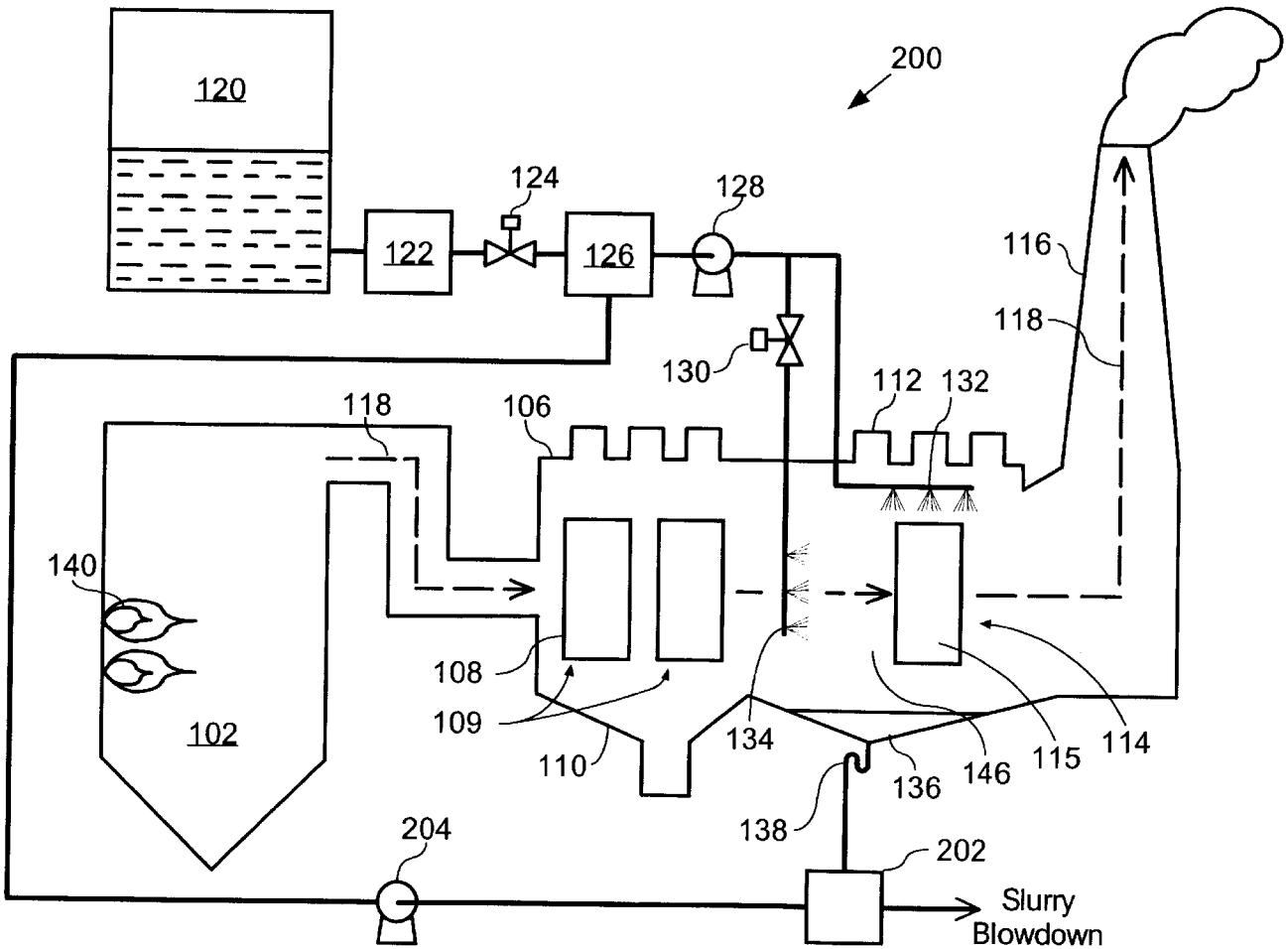
FIG. 2 is a diagrammatic view of another system for decreasing the concentration of contaminants within a flue gas stream emitted by a fossil-fuel fired boiler, according to another embodiment of the invention.

This invention relates to an apparatus and method for decreasing the concentration of contaminants in a flue gas stream emitted by a fossil-fuel fired boiler, by using a hybrid electrostatic precipitator (ESP) system. FIGS. 1 and 2 are diagrammatic views of systems 100 and 200, respectively, for decreasing the concentration of contaminants present in a flue gas stream emitted by a fossil-fuel fired boiler 102. The systems shown in FIGS. 1 and 2 share a number of common components. These common components will now be described.

The fossil-fuel fired boiler 102 combusts fossil fuel at one or more burners 140 to generate heat. The generated heat is typically used to vaporize water into steam that turns a turbine and generates electricity. Fossil-fuels, as used herein, includes any hydrocarbon deposit derived from living matter of a previous geologic time that produces contaminants when combusted, for example, petroleum, coal, or natural gas. Most fossil-fuel fired boilers in operation today bum coal as their primary fuel. In a preferred embodiment, the fossil-fuel is eastern bituminous coal.

Once the fossil-fuel has been combusted in the fossil-fuel fired boiler 102, and most useable heat extracted, the hot combusted exhaust gas (hereafter "flue gas stream") is removed from the fossil-fuel fired boiler 102 via a flue or duct 104. The flue gas stream is then directed along a combusted fossil-fuel flue gas stream path (hereafter "flue gas stream path") 118 to a dry ESP chamber 106. The flue gas stream path 118 flows upstream from the boiler 102 to downstream out the flue gas outlet 116. The dry ESP chamber 106 contains numerous conductors 108, preferably plates, aligned substantially parallel to one another. In a preferred embodiment, anywhere from twenty to sixty or more conductors 108 are positioned next to one another in a group. Each group of one or more aligned conductors 108 is known as a dry ESP field 109. Although system 100 shows two dry ESP fields 109, it should be appreciated that any number of dry ESP fields 109 may be positioned along the flue gas stream path 118. The dry ESP chamber 106 also contains a dry hopper 110 for collecting particulate matter removed from the conductors 108 of the dry ESP fields 109.

Once the flue gas stream has passed through the dry ESP fields 109 (at 144) it is preferably at a temperature of approximately 300 degrees Fahrenheit. The flue gas stream is then directed along the flue gas stream path 118 into a wet ESP chamber 112, and past one or more cooling nozzles 134 that atomize water into the flue gas stream. The atomized water sprayed from the cooling nozzles 134 lowers the temperature of the flue gas stream (at 146) to a temperature not lower than the moisture saturation temperature. The temperature is preferably lowered by approximately 20 to 80 degrees Fahrenheit to approximately 280 to 220 degrees Fahrenheit. This temperature is still well above the moisture saturation temperature, which is approximately 200 degrees Fahrenheit. The flow of water, sprayed from these cooling nozzles 134, is automatically controlled to keep the flue gas stream at a predetermined temperature, preferably in a range that is 20 to 80° F. above the moisture saturation temperature of the flue gas.

In the preferred embodiment, water flow is controlled by a temperature sensor and flow valve arrangement. The temperature of the flue gas stream is lowered to slow the flue gas stream and increase the flue gas stream density. This increases the performance of the wet ESP by slowing the speed of the flue gas stream so that it spends a longer amount of time in the wet ESP 112, thereby improving contaminant removal. Furthermore, as the flue gas stream temperature is not lowered below the moisture saturation temperature, condensation does not occur, thus alleviating any potential corrosion problems.

The wet ESP chamber 112 preferably contains one wet ESP field 114 that includes of one or more conductors 115. Alternatively, more than one wet ESP field may be provided. The wet ESP chamber 112 also contains one or more wash nozzles 132. The wash nozzles 132 continuously, or alternatively, periodically, wash particulates collected on the conductors 115 into a wet hopper 136. Although the atomized water sprayed from the cooling nozzles 134 may also be collected in the wet hopper 136, in a preferred embodiment some of the water sprayed from the cooling nozzles is vaporized into the flue gas stream and, therefore, does not collect in the wet hopper 136.

The flue gas stream, having an acceptable concentration of contaminants therein, is then directed along the flue gas stream path 118 out of the wet ESP chamber 112 and vented to atmosphere through a flue gas stream outlet 116, such as a stack. In an alternative embodiment, other components may be provided along the flue gas stream path 118 prior to venting the flue gas stream to atmosphere. Furthermore, in a preferred embodiment, the dry ESP chamber 106 and wet ESP chamber 112 form part of the same continuous chamber.

It has been found, that a series of dry ESP fields, positioned along the flue gas stream path 118, followed by a wet ESP field 114 can reduce the concentration of contaminants in the flue gas stream considerably. Where a dry ESP field can reduce the concentration of contaminants by 70%, a wet ESP positioned as per this invention, can reduce the concentration of contaminants in a flue gas stream by as much as 95%. Therefore, a simple calculation reveals that to reduce a concentration of 100% of contaminants down to below 1%, five dry ESP fields are needed, whereas by placing a single wet ESP field downstream of the last dry ESP field, only three dry ESP fields are needed.

Moreover, unlike a dry ESP system, a wet ESP system also reduces the concentration of gaseous chemical compound contaminants from the flue gas stream. The gaseous chemical compounds dissolve into the atomized water sprayed by the cooling and wash nozzles to form acid solutions, which are removed from the system. Also, unlike a dry ESP system, a single wet ESP field 114 positioned prior to a flue gas stream outlet prevents particulates from being re-entrained into the flue gas stream as no rapping of the conductors 115 occurs. Finally, as only a single wet ESP field is used, the temperature of the flue gas stream can be carefully controlled so as not to saturate the flue gas, thus reducing or avoiding any downstream corrosion problems.

The solution containing the water and contaminants is then drained from the wet hopper 136. In the preferred embodiment a trap 138 is used to automatically maintain the level of solution in the wet hopper 136. The trap is preferably a vented J-drain with dimensions calculated to avoid ash buildup in the bends. The J-drain is further described in detail below in relation to FIG. 3.

The above described system is preferably a retrofit to existing power plant dry ESP systems, where the final ESP field in a series of dry ESP fields is removed and is replaced with a wet ESP field. This significantly improves the performance of small ESP systems and minimizes any impact on plant operation.

The above description explains the removal of contaminants from a flue gas stream emitted by a fossil-fuel fired boiler 102. As mentioned previously, all the components described thus far are common to both systems 100 (FIG. 1) and 200 (FIG. 2), respectively. However, the water cycle for the wet ESP field may be either a once-through cycle shown in FIG. 1 or a closed loop water cycle shown in FIG. 2. The following description sets out the details of the water cycles of the different embodiments shown in FIGS. 1 and 2.

Returning to FIG. 1, the solution collected in the wet hopper 136 is drained into a pH adjustment module 140. Besides containing water and solid particulates, the collected solution also contains acid solutions formed when gaseous chemical compounds entrained in the flue gas reacts with the sprayed water. The solution drained from the wet hopper typically has a pH of between 2.0 and 3.0. The recommended material of construction for any components of the system coming into contact with the solution is a low to moderate grade stainless steel (316, for example) where acceptable corrosion rates are on the order of 10 to 20 $\mu$m/year.

Chemicals are then added into the solution at the pH adjustment module to neutralize the acid solutions. In the preferred embodiment these chemicals are sodium hydroxide or calcium hydroxide for eastern ashes and sulfuric acid for western ashes. The solution is then pumped to a pond 142, such as an existing ash pond or a dedicated settling pond, where outfall from the pond or settling tank is at a pH that does not require further treatment prior to discharge.

Water sprayed from the cooling nozzles 134 and the wash nozzles 132 is obtained from a water source 120. In the preferred embodiment, the water source 120 is either the discharge leg of a condenser or a river. Water is pumped from the water source 120 by pump 128, preferably at a rate of from 5 to 15 gpm per megawatt of power plant capacity. The water is preferably passed through a suitable coarse filter 122, such as sand filter, before reaching a make-up water control valve 124, which controls the flow of water into a control tank 126. The water is then pumped directly from the control tank to the wash nozzles 132. A flue gas temperature control valve 130 is preferably positioned between the control tank and the cooling nozzles 134 to control the flow of water to the cooling nozzles 134. The flue gas temperature control valve 130 controls the spray of water from the cooling nozzles and, therefore, is used to control the temperature of the flue gas stream entering the wet ESP chamber 112. A temperature sensor may be positioned in the wet ESP exit flue gas stream path to control the flue gas temperature control valve 130.

The water from the water source is preferably not otherwise treated chemically. This allows for a relatively low cost supply of water, thereby minimizing the overall cost of the water treatment system for the wet ESP field. This water cycle also produces long-term reliable operation and integrates into the existing water system of a power plant in a way that has minimal impact on other plant systems.

FIG. 2 is a diagrammatic view of another system 200 for decreasing the concentration of contaminants within a flue gas stream emitted by a fossil-fuel fired boiler 102. In this embodiment, the water sprayed from the cooling nozzles 134 and the wash nozzles 132 flows through a closed-loop water cycle. The solution collected in the wet hopper 136 is drained into a treatment processor 202 that controls the water chemistry. The treatment processor 202, described in further detail in relation to FIG. 3, basically chemically treats the solution and separates the solution into slurry and clarified water, where slurry is a mixture of water and particulate matter. A pump 204 pumps the clarified water to the control tank 126. Water from the control tank 126 is then used to feed the cooling nozzles 134 and the wash nozzles 132, as described above. In this way, the water is recirculated through a closed-loop water cycle. Although most water can be supplied from the recirculated water, some water is lost through evaporation, system leaks, combined in the slurry, etc. For this reason some make-up water is provided by the water source 120. The make-up water control valve controls the flow of water from the water source 120 to the control tank, as needed. In the preferred embodiment, the make-up water control valve 124 is a control valve actuated by a level signal, such as a float-valve, that adds make-up water to the control tank when the water level drops below a predetermined height. In the preferred embodiment, the make-up water is taken from a discharge leg of the condenser, river, and/or cooling tower blowdown, at a rate of from 1.2 to 2.0 gpm per megawatt of generating capacity. Furthermore, in the preferred embodiment, water is pumped into the wet section at a rate of 5 to 15 gpm per megawatt so that the make-up water constitutes a small fraction of the water used by the cooling nozzles 134 and the wash nozzles 132 (FIG. 2).

Figure 3:
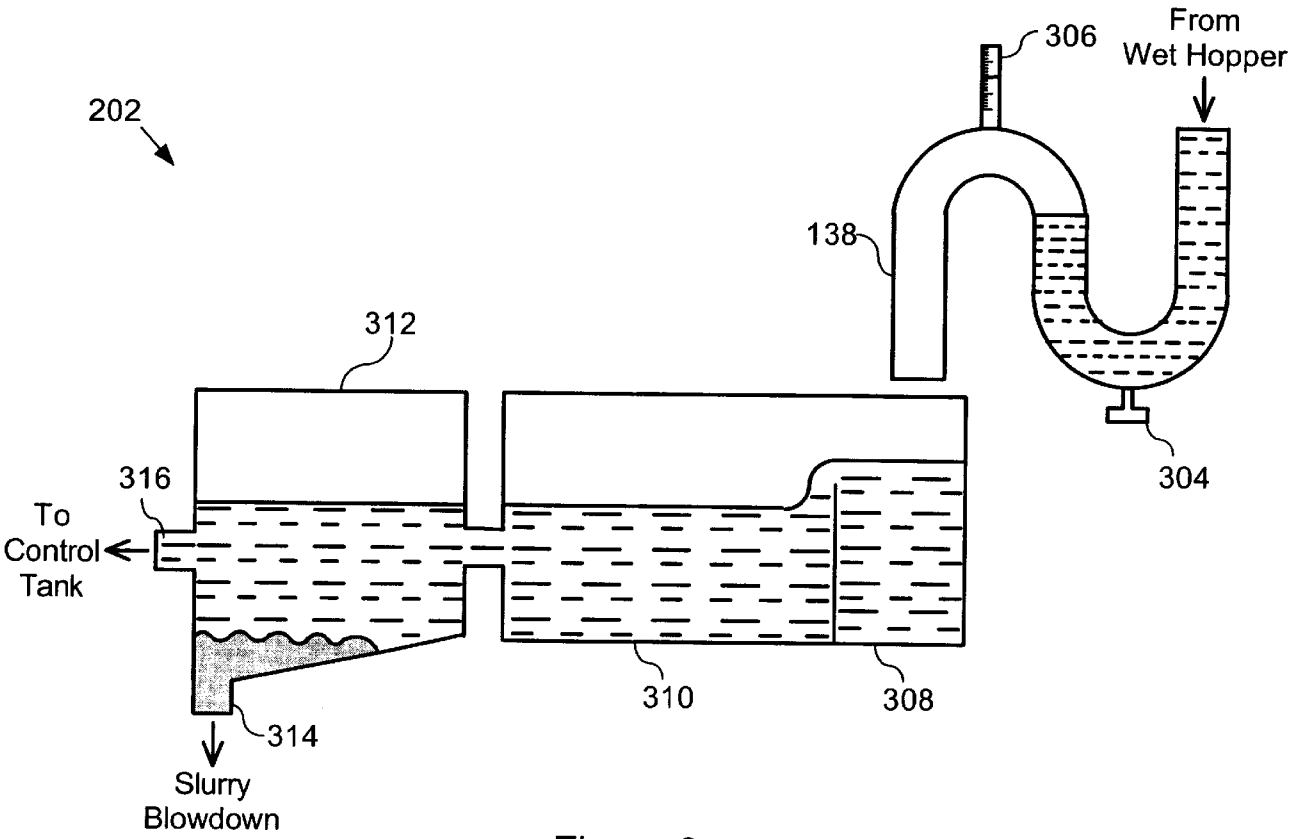
FIG. 3 is a diagrammatic view of a J-drain and treatment processor, according to the embodiment of the invention shown in FIG. 2.

FIG. 3 is a diagrammatic view of a J-drain 138 and treatment water processor 202 according to the embodiment of the invention shown in FIG. 2. The J-drain 138 may also be used with the embodiment of the invention described in relation to FIG. 1. The solution in the wet hopper 136 (FIG. 2) is drained into the treatment water processor 202, preferably via the J-drain 138. The J-drain automatically maintains the level of the solution in the wet hopper. A gauge 306 is preferably provided to indicate the flow of solution through the J-drain. In the preferred embodiment, the gauge 306 is a transparent tube extending vertically from the J-drain. Flow stoppage can be visually ascertained by reading the gauge 306. Should a blockage occur in the J-drain, the blockage can be removed from the J-drain through a removal port 304.

Typically, the solution drained from the wet hopper 136 (FIG. 2) has a pH of 6.8, suspended solids that range from 200 to 1410 mg/L, calcium levels that average around 207 mg/L, magnesium levels that average around 2.11 mg/L, silicon levels that average around 13.8 mg/L, and chloride levels that average around 238 mg/L. This solution is treated with a unique process that utilizes two different treatment regimes, one during start-up and one during steady operation. During start-up, soda ash slurry or caustic (sodium hydroxide), is added to a reaction tank that receives the ESP drain water to raise the pH. A lime slurry, ferric sulfate solution, and polymer are also added. After proper operation, which includes drop-out of silica, calcium, magnesium, iron and aluminum minerals, the process shifts to the addition of a lime slurry, ferric sulfate solution and polymer solution only so as to control the water chemistry of the stream that is recirculated into the wet ESP section to within the following ranges. The treated water had a pH of 12, with suspended solids ranging from 2 to 16 mg/L, calcium levels averaged 192 mg/L, magnesium levels averaged 0.648 mg/L, and silicon levels averaged 2 mg/L. With this treatment system, the drain water is not corrosive to carbon steel or stainless steel, from which the recirculated water and wet ESP sections are preferably constructed.

The treatment processor preferably comprises a flash mixer 308 that quickly mixes the solution with a polymer, ferric sulfate, caustic, and/or lime slurry. The solution then flows into a slow mixer 310 that slowly stirs or mixes the solution with the above described chemicals and allows formation of precipitates. The solution then flows into a clarifier 312 where the heavier particulates form a slurry 314. The slurry is then extracted from the clarifier, preferably at a rate of from 0.8 to 1.5 gpm per MW of electric generating capacity, and thereafter treated for disposal. This is also known as slurry blown down, which is the waste stream from the treatment process. The blow down is treated by mixing with a larger wastewater stream or acidified with sulfuric acid to bring the pH down to about 7.5.

This unique system 200 (FIG. 2) maintains a water chemistry that produces little corrosion or scaling, and produces reliable wet ESP operation. The unique process also minimizes chemical costs by using low-cost chemical reagents during the periods of steady operation.

Figure 4A:
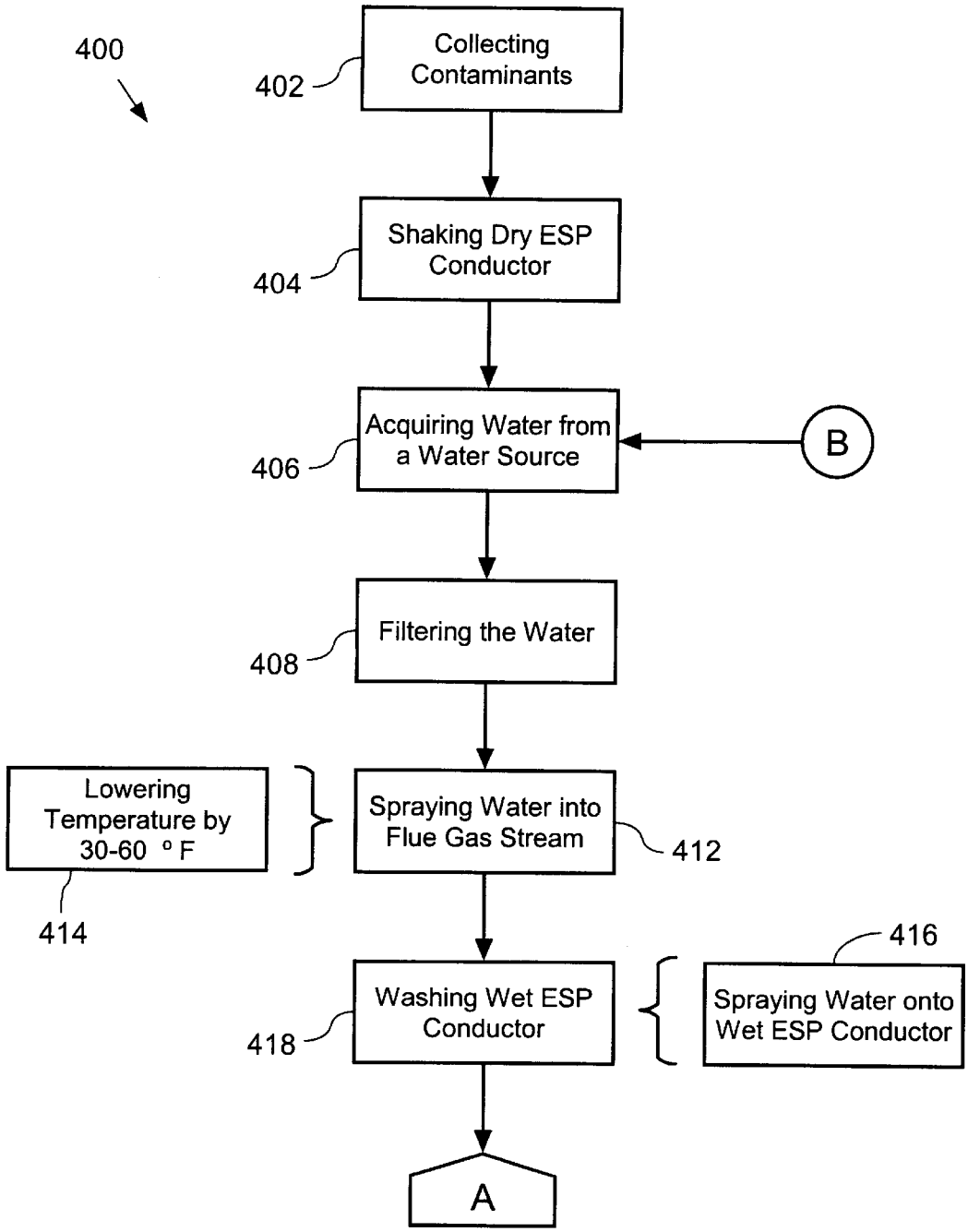
FIGS. 4A and B are flow charts of a method for decreasing the concentration of contaminants within a flue gas stream emitted by a fossil-fuel fired boiler, according to the embodiment of the invention shown in FIG. 1.
Figure 4B:
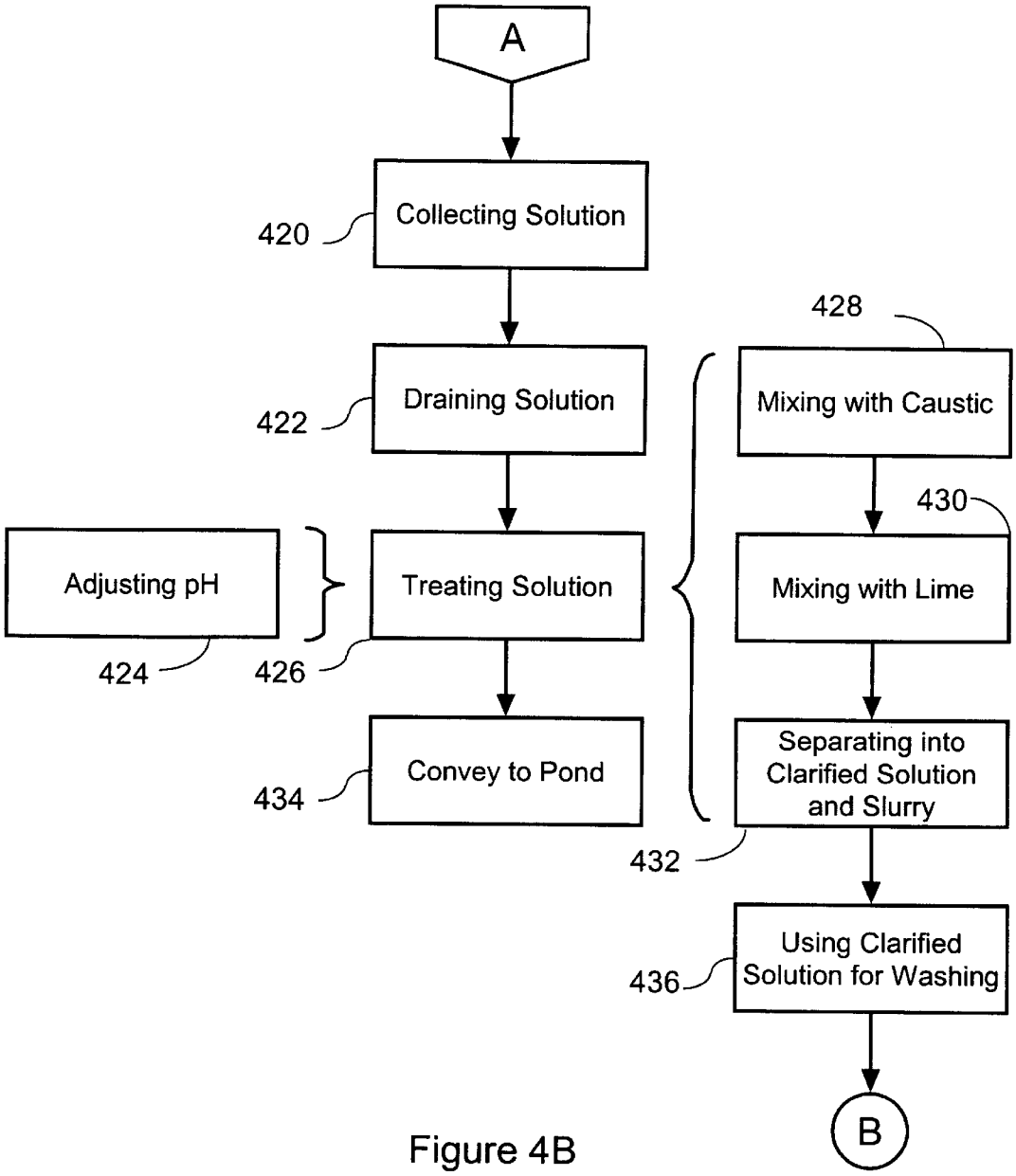

FIGS. 4A and B are flow charts of a method for decreasing the concentration of contaminants within a flue gas stream emitted by a fossil-fuel fired boiler, according to the embodiments of the invention shown in FIGS. 1 and 2. Fossil-fuel is firstly combusted in a fossil-fuel fired boiler, which produces a flue gas. The flue gas is directed along a flue gas stream 118 (FIGS. 1 and 2) into a dry ESP chamber 106 (FIGS. 1 and 2), where contaminants entrained in the flue gas stream are electrostatically collected (step 402) on dry ESP conductor/s 108 (FIGS. 1 and 2). The flue gas stream is then directed into a wet ESP chamber 112 (FIGS. 1 and 2) disposed downstream of the dry ESP conductor/s, where contaminants entrained in the flue gas stream are electrostatically collected (step 402) on wet ESP conductor/s 115 (FIGS. 1 and 2). The dry ESP conductor/s 108 (FIGS. 1 and 2) are then rapped or shaken (step 404) to remove contaminants collected thereon.

Water is then sprayed (step 412) into the flue gas stream as it enters the wet ESP chamber 112 (FIGS. 1 and 2). This preferably lowers (step 414) the flue gas temperature by 20 to 80 degrees Fahrenheit, as described above. Spraying water into the flue gas stream also allows gaseous chemical compounds entrained in the flue gas stream to dissolve into the sprayed water, thereby be removing them from the flue gas stream. The contaminants collected (step 402) on the wet ESP conductor/s 115, preferably particulates such as fly ash, are then washed (step 418) from the wet ESP conductor/s. Washing (step 418) of the wet ESP conductor/s preferably occurs by spraying (step 416) water onto the wet ESP conductor/s.

A solution of contaminants and water is then collected (step 420) in a wet hopper 136 (FIGS. 1 and 2). The solution is drained (step 422), preferably through a J-drain 138 (FIGS. 1 and 2), from the wet hopper, and the drained solution is treated (step 426).

In the once through water cycle embodiment, shown and described in relation to FIG. 1 above, the treatment step (step 426) comprises adjusting (step 424) the pH level of the solution prior to conveying (step 434) the solution to a ash or settling pond where outfall can occur. In this embodiment, water is initially acquired (step 406) from a water source, preferably an untreated water source such as a river or an outlet from a condenser, and filtered (step 408), preferably through a coarse filter, prior to being sprayed (steps 412 and 416).

In the closed loop water cycle embodiment, shown and described in relation to FIG. 2 above, the treatment step (step 426) comprises firstly mixing (step 428) the solution with a caustic solution (Sodium Hydroxide) during system startup, and thereafter mixing (step 430) the solution with the polymer, ferric sulfate, caustic, and/or lime slurry, as described above. The solution is then passed into a clarifier where it is separated (step 432) into a clarified solution of mainly water, and a slurry of water and contaminants. The slurry is then conveyed (step 434) to a settling or ash pond where outfall can occur.

The clarified solution is then used (step 436) for the washing (step 410) and spraying (step 412) steps described above. Should any additional make-up water be required, water is acquired (step 406) from a water source, filtered (step 440), and then added as make up water to the control tank 126 (FIG. 2).

An example of a pilot scale test for the above systems, will now be described.

EXAMPLE

1. Introduction

Initial pilot-scale tests funded by the assignee of this invention, Electric Power Research Institute (EPRI), indicated that a relatively small, wet electrostatic precipitator (wet ESP) can achieve very high fine particulate collection efficiencies. The results indicate that replacement of the last stage of a small dry ESP with a single wet field can produce a significant reduction in outlet particulate emissions—from over 0.1 lb/$10^6$Btu (0.043 g/MJ) to under 0.03 lb/$10^6$Btu (0.013 g/MJ) under some conditions. The pilot study did not, however, address the water cycle for the process; and a simple, reliable and relatively inexpensive water treatment system is needed to make this technology an attractive option for electric utilities.

This example contains the results from a pilot-scale once-through and closed loop water cycle test. Results of flue gas testing to determine removal efficiency of particulates, $SO_2$, HE and HCl for the wet ESP, are also included.

Purpose

The purpose of this current study was to evaluate the field application of two water use concepts identified for the assignee by Southern Company Services (SCS). In addition, data were also needed on particulate and acid gas removal efficiency for the wet ESP. To accomplish these goals, a small pilot wet ESP module was used at Alabama Power Company's E.C. Gaston Generating Plant. Flue gas from the exhaust side of the Unit 4A induced draft fan was fed to a wet ESP test module. The flue gas is gas that has already been treated by a hot-side ESP (dry ESP), and it enters the wet ESP module at a temperature of 230–240° F. (110–115.6° C.). Most of the coarse particulate matter in the gas has already been removed. In the pilot test case evaluated, the goal of the wet ESP was to remove fine ash particles that could not be captured by a conventional dry ESP.

The specific goals of the project were to:

(1) evaluate the effects of two water use scenarios on metal corrosion and scaling rates;

(2) assess management of wastewater from the wet ESP in an ash pond or basin;

(3) evaluate the water chemistry, process control performance and economics aspects of water treatment for the recirculation (closed loop) case; and (4) measure the removal efficiency of particulate, $SO_2$. HCL and HF for the wet ESP. For particulates, measure removal efficiency as a function of approach to moisture saturation of the flue gas.

The two water use cases evaluated were for the following configurations: (1) a once-through water cycle, and (2) a recirculated or closed loop water cycle, both for a wet ESP. For both cycles, the make-up water source was river water that had been filtered through a mixed media filter to remove floating debris and particles that could cause blockage of the spray nozzles.

Background

Flue Gas Cleaning

The removal of particulates, aerosols and certain gases by a wet ESP has been studied previously for the assignee by Southern Research Institute (SRI). The results from that study indicated that:

1. The wet ESP was effective at collecting fly ash. For average inlet ash loadings ranging from 0.28 to 1.62 lb/$10^6$Btu (0.12 to 0.7 g/MJ), the mass collection efficiency ranged from 94% to 98% using cascade impactor tests. As a result of the high particulate matter capture, the wet ESP also had a very high removal rate for several metals.
2. The wet ESP particulate removal efficiency improved slightly with decreasing outlet gas temperature. For example, the average particulate removal efficiency was 97% for an outlet gas temperature of 135° F. (57.2° C.), and 94% at 175° F. (79.4° C.).
3. The wet ESP was quite effective in removing $SO_3$. The removal rate ranged from 57% to 73% for inlet $SO_3$ concentrations ranging from 6.9 ppm to 12.4 ppm.
4. The wet ESP particulate removal efficiency appeared to improve slightly with increasing inlet gas particulate loading.
5. The wet ESP was slightly effective in removing $SO_2$. The removal rate ranged from 15% to 24% for inlet $SO_2$ concentrations ranging from 504 ppm to 645 ppm.
6. The wet ESP was somewhat effective in removing mercury from the flue gas. For total mercury, observed removal rates ranged from 25% to 35%. For oxidized mercury species, the removal rate ranged from 47% to 57%.

Wastewater Treatment

Water was used in the wet ESP for washing ash off the collector plates and removing ash from the wet ESP field conductors. As a result, some water was lost through evaporation into the hot gas. The water that contains the ash had to be discharged, or reused in the wet ESP. Scaling, corrosion and abrasion tendencies of the water were also controlled as the water was to be reused in the wet ESP. The economics of wastewater discharge, treatment, management and reuse was studied in an earlier conceptual design study performed for the assignee of this invention by SCS. The study focused on finding a workable solutions for retrofitting a wet ESP into existing power plants using dry ESPs. Specifically, simple, reliable and relatively inexpensive water treatment processes are needed to make the wet ESP technology an attractive option for electric utilities. The study focused on this need by evaluating established water treatment technologies for addressing water use and chemistry issues for the wet ESP at existing power plants. The selected process or processes meet operation goals with minimal total levelized costs—capital plus operation and maintenance. In addition, the water treatment technology had to integrate easily into a power plant's overall water management scheme with minimal impact.

The earlier study produced the following conclusions:

1. The fuel type is an important factor in determining the water use schemes that can be used. For example, PRB coal ash typically produces an alkaline leachate that has a scaling tendency. Bituminous coal ash generally produces an acidic leachate that can be corrosive. These tendencies must be controlled for once-through and recirculated water uses
2. Dissolved solids and suspended solids must be controlled in recirculated water cases to avoid abrasion damage to the wet ESP spray nozzles and piping.
3. In the simplest process identified, water from the condenser cooling water discharge can be used, with discharge of the ash slurry to an ash pond or small basin. For the once-through operation, the water feed needed for a wet ESP on a 250 MW unit is estimated to be 2,000 gpm (7570 liters/min) or less.
4. If the plant has a cooling tower, the wet ESP can be operated in a recirculated mode using cooling tower loop water as makeup. This process would produce a smaller slurry stream that can be managed using a basin or another solids separation process. Makeup water needs for the recirculated water use mode are expected to be in the 300 to 500 gpm (1135.5 to 1892.5 liters/min) range fora 250 MW unit. In addition, reuse of the water will require use of a cold lime softening process using a clarifier for solids separation. Use of the cold lime softening process also allows lower quality water to be used as makeup, e.g., cooling tower blowdown or reverse osmosis plant reject.
5. In the event that makeup water sources are scarce, makeup other than river water can be used. For a 250 MW unit, about 70 gpm (265 liters/min) of reject water may be available from a reverse osmosis plant. As well, about 300 gpm (1136 liters/min) of cooling tower blowdown water may be available.
6. The capital cost for retrofitting the last field of a dry ESP to wet ESP operation was estimated to be approximately $5 million (1995-dollars without contingencies). The cold lime water treatment plant was estimated to cost $1 million in capital and $560,000 per year in operation and maintenance. The water treatment operation and maintenance cost was estimated for PRB coal ash, and should be significantly lower for bituminous coal ash. If no water treatment is required for the wet ESP, the cost of piping and pumps to use and dispose of the water should be less than $400,000, depending on the plant layout and the location of the wastewater basin.

7. The use of a wet ESP requires careful consideration of water availability and composition on a site-specific basis. In addition, the chemical composition of water to be used in a wet ESP is an important factor determining water treatment requirements.

Field Data Needs Identified

The previous study by SCS also identified the need to collect field data for the following:

Expected corrosion rates for wet ESP use for bituminous coal fired plants

Water evaporation loss rate, clarifier blowdown rate, and minimum makeup water requirement Water treatment process chemical usage rates Ease of process control Process economics, especially factors related to water treatment and waste management 2. Pilot Test Program Description of Facility The pilot wet ESP test was performed at Alabama Power Company's E.C. Gaston Generating Plant in Wilsonville, Ala. The plant uses once-through cooling water from the Coosa River. River water that has been screened using a mixed media filter was used to supply the wet ESP during the test program. The screened river water is readily available, and is used for floor washing, coal conveyor belt dust suppression and fire protection. The plant burns an eastern bituminous coal that has a low sulfur content and gross heating value of about 12,400 Btu/lb (28.8 MJ/kg).

Wet ESP Configuration

Figure 5:
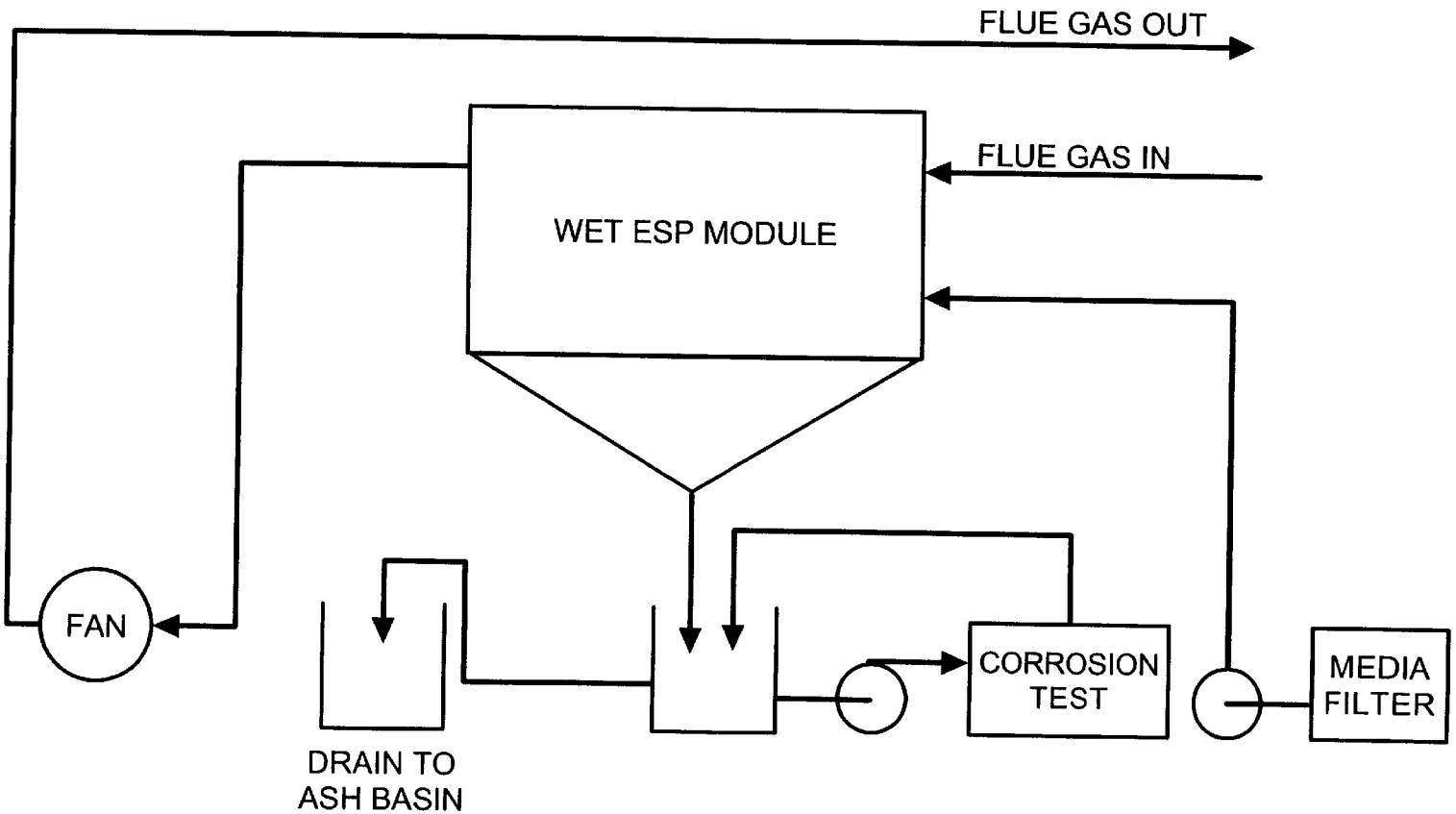
FIG. 5 is a block diagram of a wet ESP using a once through water cycle as used in a exemplary test.

The wet ESP pilot process operates on a slipstream of the Unit 4 flue gas, as shown schematically in FIG. 5. A small portion of the flue gas from the Unit 4A induced draft fan discharge is routed to the wet ESP using a 2-foot diameter steel duct. Prior to treatment in the wet ESP, the flue gas is cleaned by a conventional ESP. As a result, the gas entering the wet ESP has a low particulate loading. The pilot plant includes a fan on the outlet side of the wet ESP to draw gas through the wet ESP and back into the main Unit flue gas duct. A venturi on the discharge side of the pilot process fan is used to measure gas flow. A manual damper at the inlet to the pilot process fan is used to control gas flow through the wet ESP. The maximum design flow for the wet ESP, fan and ducting was in the range 11,000 to 12,000 acfm (5.19 to 5.66 $m^3/s$), or nominally 11,050 acfm (5.21 $m^3/s$). At this flow, the power generation equivalence of the wet ESP module is about 3 MW (electric). Based on the size of the wet ESP module, the residence time for the gas in the wet ESP is 0.83 seconds in the energized first field.

The wet ESP module energized section provided an SCA of 9.22 sec/in (46.74 $ft^2$/1000 acfm) (acfm at entry temperature) and a gas residence time of 0.69 seconds in the first field. A summary of the wet ESP parameters is given in Table 1. The module body, plates and wet hopper are all made of 304 stainless steel. The electrodes are made of 304 stainless steel. The nozzles for spraying water in the wet ESP are also made of stainless steel. The scaling and corrosion test provisions made for the water loop, however, include both 316 stainless steel and carbon steel.

TABLE 1

Wet ESP Operating Parameters

| | | |
|---|---|---|
| Estimated Power Output Equivalent for Treated Flue Gas (MW electric) | 3 | |
| Number of Gas Passages | 4 | |
| Gas Flow Area | 25.84 $ft^2$ | 2.4 $m^2$ |
| Volumetric Gas Flow (at inlet temperature of 235° F.) | 11,050 acfm | 5.21 $m^3/s$ |
| Gas Velocity | 7.13 ft/sec | 2.17 m/s |
| Area per Plate-One Side Only | 32.28 $ft^2$ | 3 $m^2$ |
| Total Plate Area-One Field | 258.24 $ft^2$ | 24.00 $m^2$ |
| SCA per Field | 23.37 $ft^2$/1000 acfm | 4.61 s/m |
| Residence Time-One Field (seconds) | 0.69 | |
| Number of Available Fields in Direction of Gas Flow | 2 | |
| Number of Energized Fields for Once-Through Water Use Test | 1 | |

Spray Configuration

The wet ESP employs four plate wash lances and two gas cooling lances. Each lance has eight nozzles. The plate wash lances direct water onto the plates near the top edges to completely wet the plate surface and wash collected ash down into the wet hopper. The two gas cooling lances cool the incoming flue gas to a desired set point so as to optimize wet ESP performance. In total, the lances use a total water flow of about 11.2 gpm (42.4 liters/min).

Water Source and Wastewater Management

The water used for the pilot test is taken from the plant's service water system that is fed by filtered river water. The testing was performed in two water use modes:

1. Open loop, where the water is used once in the wet ESP as spray water, and then discharged to a continuously flowing stormwater/blowdown drain. Ultimately, the drain water is pumped to an ash basin and co-managed with ash sluice water. The plant has a flyash and bottom ash sluicing system, and no ash is handled dry.
2. Water reuse, with sludge blowdown from the cold lime water softening/clarifier process. Ash from the wet ESP plates and some of the dissolved solids in the wet ESP drain water are removed as settleable solids. These solids are removed from the process and discharged to the stormwater/blowdown drain as a sludge. The treated water is reused as spray water in the wet ESP. The cycles of concentration for the water recycle operation was determined using chemical analyses for makeup water and for water entering the water treatment process from the wet ESP hopper. The process was operated to maximize discharge sludge solid content while maintaining a clear water feed to the wet ESP sprays. In this way, the need for makeup water can be minimized while managing the risk of wet ESP spray nozzle pluggage. Corrosion rates were monitored, since higher water reuse rates can result in higher chemical concentrations in the water loop.

For both cases, the water source and ultimate wastewater disposal method were the same.

3. Water Use Test Results

Introduction

Initial tests with the wet ESP were performed in a one-month period with the wet ESP operated in the once-through water use mode. In the next phase, the wet ESP drain water was treated using a cold lime softening process and reused in the wet ESP. The ash removal efficiency of the wet ESP with just the first field energized is estimated to be more than 92% based on suspended solids measurements for the wet ESP drain water.

The eastern bituminous coal burned during tests had a gross heating value of about 12,400 Btu/lb (28.8 MJ/kg) which is somewhat typical of eastern bituminous coal. The total ash content of the coal was about 12% by weight. An as received basis laboratory analysis for the coal burned during the pilot tests is provided in Table 2. The coal ash produced at Plant Gaston during the test had the properties summarized in Table 3.

TABLE 2

Coal Composition - As Received Basis

| Element | Concentration (Average) |
|---|---|
| Moisture (wt. %) | 7.85 |
| Ash (wt. %) | 11.87 |
| Heat of Combustion (Btu/lb, MJ/kg) | 12,416/28.84 |
| Carbon (wt %) | 70.97 |
| Hydrogen(wt. %) | 3.93 |
| Nitrogen (wt. %) | 1.46 |
| Oxygen (wt. %) | 3.12 |
| Carbon, fixed (wt. %) | 58.61 |
| Volatiles (wt. %) | 21.67 |
| Chlorine (mg/kg) | 142 |
| Fluorine (mg/kg) | 34 |
| Sulfur (wt. %) | 0.8 |
| Aluminum (wt. %) | 1.6 |
| Calcium (wt. %) | 0.2 |
| Iron (wt. %) | 0.4 |
| Magnesium (wt. %) | 0.07 |
| Silicon (wt. %) | 2.6 |
| Sodium (wt. %) | 0.05 |
| Barium (mg/kg) | 225 |
| Manganese (mg/kg) | 19 |

TABLE 3

Coal Ash Mineral Composition

| Mineral | Concentration in Ash (wt %) |
|---|---|
| $Al_2O_3$ | 30.43 |
| $Fe_2O_3$ | 7.37 |
| CaO | 3.05 |
| MgO | 1.47 |
| $P_2O_5$ | 0.54 |
| $K_2O$ | 2.16 |
| $SiO_2$ | 50.29 |
| $Na_2O$ | 0.58 |
| $SO_3$ | 0.46 |
| $TiO_2$ | 1.22 |

Open Loop Water Use Test Results

Water used to feed the wet ESP process had the chemical composition that is summarized in Table 4. For comparison purposes, the table also includes the chemical composition of the water after it has been used once in the wet ESP. Note that the chemical composition for metals is based on allowing the solids to settle in the sample bottle prior to pouring the water off for laboratory analysis. The incoming water and drain water temperatures and corrosion rates were also noted. For the corrosion rate, an electrical method was used to get a reading for carbon alloy steel and 316 stainless steel.

TABLE 4

Chemical Analysis Results for Feed Water and Once-Through Drain Water (Total metal analyses represent aqueous concentrations that can be expected after gravity settling of solids)

| Analytical Parameter | Incoming Water (Range, Average) | Drain Water (Range, Average) |
|---|---|---|
| pH | 6.83–7.30, 7.06 | 2.71–2.83, 2.77 |
| Temperature (° C.) | 23.1–28, 25.5 | 36.5–42, 39.2 |
| Total Dissolved Solids (mg/l) | 128–147, 137 | 257–333.296 |
| Total suspended Solids (mg/l) | ND-4, 3 | 57–187.112 |
| Sp. Elec. Cond. (μS/cm at 25° C.) | 286 | 952 |
| Total Hardness (mg/l as $CaCO_3$) | 71.4 | 73.5 |
| Acidity* (Std. Method 2310) (mg/l) | — | 198–245, 222 |
| Chloride (mg/l) | 10.2–29.4, 22.5 | 3.43–42.9, 41 |
| Sulfate (mg/l) | 25.7–35.3, 31.3 | 456–641, 559 |
| Fluoride(mg/l) | 0.09–0.13, 0.11 | 0.86–22.94, 8.22 |
| Aluminum (mg/l) | 0.006–0.132, 0.085 | 1.29–13.6, 5.44 |
| Calcium (mg/l) | 0.01–21.2, 13.7 | 19.4–40.2, 27.2 |
| Iron (mg/l) | 0.002–0.113, 0.05 | 7.516–20.4, 14.5 |
| Magnesium (mg/l) | 0.01–6.49, 4.18 | 6.08–8.36, 7.03 |
| Potassium (mg/l) | 0.01–1.78, 1.18 | 1.94–5.87, 3.32 |
| Silicon (mg/l) | 0.005–1.70, 1.10 | 3.02–10.7, 5.9 |
| Sodium (mg/l) | 0.01–17.03, 10.31 | 14.14–20.79, 17.87 |

*End point of 8.3 for pH.

The wastewater from the wet ESP can be discharged to an ash basin using existing pipes that transport ash sluice water. If the ash is handled dry, a small settling basin may need to be constructed if one is not already available. If a separate basin is used, the pH will need to be increased to about 6 using sodium hydroxide to allow discharge to surface water. This should also allow reduction of the dissolved chemical levels through precipitation and adsorption. The water that overflows from the basin may need additional treatment prior to discharge to surface water. Alternatively, the overflow might be reused in the plant for other purposes, e.g., for floor washing.

The water usage rates were generally lower than expected for the flue gas flow being treated. A summary of measured water flows is given in Table 5. The net water loss through water evaporation from the plates and from use of the cooling sprays was estimated to be 3% of the gross water feed to the wet ESP. Water and gas temperatures were used in a heat balance to derive the water loss by evaporation. The exit flue gas temperature was controlled at 170° F. (76.7° C.) while the inlet flue gas temperature varied between 230–240° F. (110–115.6° C.). The flue gas flow rate at the wet ESP inlet temperature was measured using a venturi to be between 10,900 and 11,200 acfm (5.14 to 5.29 $m^3/s$)

TABLE 5

Water Usage Rates for Wet ESP (Once-Through Water Use)

| Water Stream | Average Flow (gpm, liters/min) |
|---|---|
| Gross Water Feed to Wet ESP | 11.2, 42.4 |
| Water Feed to Wash Plates | 8.03, 30.3 |
| Water for Gas Cooling Spray* | 3.17.12 |

*Estimated water evaporation rate of 0.35 gpm (1.3 liter/min).

Instantaneous corrosion rate measurements were performed to assess the suitability of materials for piping incoming water and wet ESP drain water. The results are summarized in Table 6. The drain water was extremely corrosive to carbon steel. The initial installation of carbon steel electrodes was almost completely destroyed.

TABLE 6

Corrosion Rate Measurements and Related Water Quality Parameters

| Parameter | In-Coming Water | Drain Water |
|---|---|---|
| Corrosion Rate for Alloy Steel (μm/yr) | 114 | >507* |
| Corrosion Rate for 316 Stainless Steel (μm/yr) | 8 | 14 |
| pH | 6.83–7.3 | 2.71–2.83 |
| Temperature (° F., ° C.) | 74–82, 23.1–28 | 98–108, 36.542 |
| Total Dissolved Solids (mg/l) | 128–147 | 257–333 |
| Sp. Electrical Conductance (μs/cm) | 286 | 952 |
| Dissolved Oxygen (mg/l) | 8.63 | 0.13 |
| Dissolved Oxygen (% Saturation) | 101.3 | 1.9 |
| Free Carbon Dioxide (mg/l) | 5.6 | 0 |

*prior to pH adjustment.

Management of Wet ESP Wastewater

Acidity of the wet ESP drain water can be managed by raising the pH of the spray water. For example, results from the open loop testing show that the pH of sprayed water falls from a value of about 7 to a value of about 2.5 in the drain water. If the target pH in the drain water is 6.5 to control corrosion of the wet ESP internals and drain plumbing, the pH of the spray water should be a raised to a value of about 11. The least expensive way to accomplish the pH adjustment for spray water is by addition of a sodium hydroxide solution. The drain water can be managed by mixing with ash sluice water, or in a separate basin designed to allow suspended ash to settle.

Recycle Loop Water Treatability Test Results

In order to reach the best chemical addition rates quickly, a sample of the wet ESP drain water from the open loop water use test was used in a series of laboratory jar experiments. The results helped to optimize the chemical feed rate settings for the cold lime softening process. Soda ash is used to remove hardness caused by calcium sulfate and calcium chloride present in the wet ESP drain water. Lime is used to reduce hardness caused by calcium and magnesium bicarbonate, magnesium sulfate and magnesium chloride. As a result, insoluble solids are produced. Ferric sulfate is used to bind fine particles into larger settleable solids. The clarifier allows solids to settle to the bottom and be removed continuously as sludge.

The low loss of water by evaporation in the wet ESP indicates that water loss in the sludge blowdown will be the primary factor controlling the closed loop equilibrium concentration of soluble chemicals. Such soluble chemicals include chloride and fluoride.

Closed Loop Water Use Test Results

The wet ESP was operated in a closed loop water use mode with drain water from the module treated by a cold-lime softener clarification process. As a result, the consumptive water use of the wet ESP was reduced from 11.2 gpm (42.4 L/min) in the once-through water use mode to 3.35 gpm (12.7 L/min). This represents a 70% reduction in water usage.

The water usage rates were generally lower than expected for the flue gas flow being treated. A summary of measured water flows is given in Table 7. The net water loss through water evaporation from the plates and from use of the cooling sprays was estimated to be 3% of the gross water feed to the wet ESP. Water and gas temperatures were used in a heat balance to derive the water loss by evaporation. The exit flue gas temperature was controlled at 170° F. (76.7° C.) while the inlet flue gas temperature was about 232° F. (90° C.). The flue gas flow rate at the wet ESP inlet temperature was measured using a venturi to be 10,422 acfm (4.92 $m^3/s$), which is equivalent to approximately 2.74 MW (electric).

TABLE 7

Water Flowrates for Closed Loop Mode

| Water Stream | Average Flow (gpm. liters/min) | Observed Range (gpm. liters/min) |
|---|---|---|
| Gross Water Feed to Wet ESP | 11.2, 42.4 | |
| Water Feed to Wash Plates | 8.03, 30.3 | Not measured directly |
| Water for Gas Cooling Spray* | 3.17, 12 | |
| Blowdown from Clarifier | 3.0, 11.3 | |

*Estimated water evaporation rate of 0.35 gpm (1.3 liters/min).

Instantaneous corrosion rates for carbon steel and 316 stainless steel were measured to be zero for the treated water leaving the clarifier.

Water chemistry analyses indicate that the wet ESP is effective in removing a number of chemicals from the flue gas stream as well as fly ash. Particulate matter was removed very well from the flue gas. In order of effectiveness, the chemicals removed include sulfate, chloride, fluoride and nitrate. A summary of the water chemistry measurements is provided in Table 8.

TABLE 8

Water Chemistry Results for the Closed Loop Mode-Treated Water and Drain Water

| Analytical Parameter | Incoming Water (Range, Average) | Drain Water (Range, Average) |
|---|---|---|
| pH | 12.12 | 6.80 |
| Temperature (° F., ° C.) | 85, 29.4 | 97, 36.2 |
| Total Dissolved Solids (mg/l) | 2524–14493, 6929 | 1302–15493, 7577 |
| Total Suspended Solids (mg/l) | 2–16, 9 | 200–1410, 742 |
| Sp. Elec. Cond. (μS/cm at 25° C.) | 10300 | 6550 |
| Total Alkalinity (mg/l as $CaCO_3$) | 1989–6960, 3626 | 0 to 5820, 1324 |
| Chloride (mg/l) | 73–221, 147 | 216–253, 238 |
| Sulfate (mg/l) | 69–3044, 1641 | 1228–4887, 2475 |
| Fluoride (mg/l) | 6–55, 25 | 10.7–88.5, 36.7 |
| Aluminum (mg/l) | 0.18–2.66, 1.43 | 1.9–15.3, 11 |
| Calcium (mg/l) | 1.15–816, 192 | 14.5–589, 207 |
| Iron (mg/l) | 0.026–0.774, 0.206 | 0.25–32.7, 20 |
| Magnesium (mg/l) | 0–5.21. 0648 | 0.81–6.06, 2.11 |
| Potassium (mg/l) | 8.52–17.17, 13.14 | 12.34–25.1, 18.8 |
| Silicon (mg/l) | 0–8.58, 2 | 7.42–22.6, 13.8 |
| Sodium (mg/l) | 0–724, 164 | 0–373, 123 |

*End point of 8.3 for pH.

The estimated chemical removal rates from flue gas are given in Table 9. Removal rates were calculated using measured flowrates and concentrations for the water treatment system blowdown and makeup streams. Note that the chemical removal rates are based on the equivalent electric power generating capacity of the pilot, i.e., about 2.74 MW (electric).

TABLE 9

Chemical Removal Hates from Closed Loop Testing

| Chemical | Removal Rate from Flue Gas (mg/min) | Removal Rate from Flue Gas (lb/year), (kg/year) |
|---|---|---|
| Particulate Matter | 29676 | 34386, 15598 |
| Sulfate | 32567 | 37737, 17117 |
| Chloride | 1666 | 1931, 876 |
| Fluoride | 473 | 548, 249 |
| Nitrate | 3.3 | 3.8, 1.7 |

Water Treatment Chemical Use

Testing showed that there was a need for two distinct water treatment protocols. One for initial startup to bring the closed water loop to a stable point, followed by a second protocol for maintaining equilibrium (see Table 10). The drain water from the wet ESP at startup had a hardness of more than 107 mg/l. The objective was to reduce the hardness of the water to less than 30 mg/l. The pH also had to be raised from a value of 2.7 at startup in the wet ESP drain to 12.0 for optimum hardness removal at the elevated water temperature of about 97° F. (36° C.). Calcium, magnesium and silicon levels in the treated water leaving the clarifier were about the same or only slightly higher than in the makeup water. These constituents often lead to scaling problems if allowed to rise to high concentrations. The process should be able to handle makeup water quality that is relatively poor, e.g., reject water from a reverse osmosis plant or cooling tower blowdown.

TABLE 10

Chemical Usage for Closed Loop Water Treatment

| Protocol | Soda Ash* (mg/l) | Lime* (mg/l) | Ferric Sulfate (mg/l) | Polymer (mg/l) |
|---|---|---|---|---|
| Chemical usage to reach equilibrium | 1200 | 680 | 10 | 0.1 |
| Chemical usage to maintain equilibrium | 0 | 200 | 15 | 0.1 |

*Fed as a slurry in water.

At steady state, the wet ESP drain water was 7.5, significantly higher than 2.7 at startup. As a result, no soda ash was needed for pH adjustment at steady state conditions. During operation, the process maintained a hardness of less than 30 mg/l at all times. Water treatment process behavior was excellent with supervision required only to maintain chemical supply. The majority of the labor required was to maintain a stock of lime slurry in the feed tank.

Management of Blowdown Water

The wet ESP water treatment blowdown has a pH that is alkaline. However, the flyash content of the water is such that the wastewater can be pumped and managed in one of two ways:

1. Mixing the blowdown with ash sluice water prior to its return to an ash pond.
2. Treating the blowdown in a specially constructed basin where the ash is separated from the liquid. The overflow from the basin can be either reused or discharged to surface water.

The scale formation potential of the blowdown water is quite high as indicated by results from geochemical modeling using the assignee of this invention's WinSEQUIL model. The results from the modeling indicate that there is a tendency to precipitate calcium carbonate, iron hydroxide and magnesium hydroxide. Under these conditions, the water is not corrosive to steel. The model also indicates that the scaling tendency can be removed by adjusting the pH of the blowdown water down to 7.5 or less from a level of about 12. At a pH of 7.5, only iron hydroxide is expected to precipitate and this should not pose a problem for long-term operation of a pipeline or pumping equipment. The pH adjustment can be accomplished by mixing the wet ESP blowdown water with acidic water, e.g., fly ash sluice water, or by addition of an acid (e.g., sulfuric acid).

The total alkalinity of the water treatment blowdown ranged from 2070 to 6440, with a mean of 4530 mg/l as $CaCO_3$. The method used to measure total alkalinity required adjustment of the pH down to a value of 4.5 using an acid, e.g., sulfuric or hydrochloric acid. This information can be used to estimate the amount of acid that would be required to reduce the pH of blowdown water down to 7.5.

Process Operating Cost

The process requires two separate chemical use schemes—one to bring the process to equilibrium after startup, and one to keep the process running. The estimated chemical costs for the two modes of operation are summarized in Table 3–10. When started the process took about 4 hours to reach equilibrium chemistry conditions. The annual chemical cost of operating the water treatment system will be about $2,055 per year for the 2.74 MW pilot unit using an estimate of 25 days per year in startup mode and 340 days in equilibrium operation mode (see Table 11). The total chemical cost will be less if the process is operated with fewer start-ups during the year.

The labor requirements of operating the water treatment system should be modest. During operation, labor was required periodically to prepare the lime and soda ash slurries. The labor requirement could be reduced on a full-scale plant by using screw feeders. The feeders would need to be checked and maintained periodically. The ferric sulfate is supplied as a solution and is fed to the process using a metering pump.

TABLE 11

Chemical Treatment Cost far the Closed Loop Mode

| Chemical Coast ($/365 days) | Startup Mode | Continuous Operation Mode |
|---|---|---|
| Lime | 3,352 | 986 |
| Soda Ash | 10,276 | 0 |
| Polymer | 5 | 5 |
| Ferric Sulfate | 135 | 203 |
| Total Chemical Cost* | 13,768 | 1,194 |

*$2,055/year total chemical cost for the 2.74 MW pilot unit.

Summary of Water Loop Test Results

The pilot wet ESP provided findings for a number of key parameters that are critical for full-scale application of the technology. The pilot-scale testing has proven a number of factors:

1. Operation of the wet ESP with the exit flue gas temperature well above the moisture saturation temperature, while achieving fly ash removal in excess of 95%.
2. Operation of a relatively simple, reliable control system for the water spray and treatment system.
3. Operation of the wet ESP in once-through water use mode can be accomplished as long as the corrosivity of acidic drain water can be controlled, e.g., by adjusting the pH of the wet ESP spray water higher, prior to spraying.

4. Operation of the wet ESP in closed loop water use mode while controlling scaling and corrosion, with the use of a cold-lime softener/clarifier water treatment process.
5. Wastewater characterization for the wet ESP in both the open loop and closed loop modes. The results will allow planning for treatment, disposal or reuse of the water.
6. Estimation of the rate of removal of sulfate, fluoride, chloride and nitrate from the flue gas by the wet ESP.

4. Flue Gas Test Results

Introduction

Flue gas sampling was conducted to measure the wet ESP's performance under various operating conditions. Samples were collected from test locations in the ducts leading to and away from the pilot wet ESP. The variables studied for their effect on particulate removal and removal of $SO_2$, HCl and HF. The flue gas was sampled for a period of four hours per test point, per run. For all runs, the inlet flue gas opacity was measured in order to estimate the particulate content. The test matrix used is shown in Table 12.

Measurements for HCL and HF were performed using EPA Method 26. The measurements for $SO_2$ were performed using EPA Method 6. Particulate measurements were performed using EPA Method 17. In each case, the gas was withdrawn from the stack through a TEFLON™ probe into glass impingers filled with absorbing solution. The gases then passed through a silica gel desiccant and into a flow rate monitoring system.

Results

The coal fired during the flue gas testing was an eastern bituminous type with the approximate analysis provided in Table 2. The fly ash collected from the coal combustion had a mineral content that is summarized in Table 3. Analytical results for coal and ash were obtained using samples collected during the flue gas testing period. The wet ESP consistently showed a particulate collection efficiency of 90 percent or greater, with an average efficiency of 93%. The results from the testing are summarized in Tables 13 and 14.

To summarize, the wet ESP performance for particulate removal was:

(1) Not significantly affected by changes in flue gas temperature in the test range evaluated.

TABLE 12

Flue Gas Testing Matrix

| Run No. | Velocity* (ft/s, m/s) | Outlet Gas Temp.** (° F., ° C.) | TR Current Density - Field 1 ($mA/m^2$) | TR Current Density - Field 2 ($mA/m^2$) | Comments |
|---|---|---|---|---|---|
| 1 | 5.9, 1.8 | 181, 82.8 | 0.5 | 0.5 | Two fields on |
| 2 | 5.9, 1.8 | 181, 82.8 | 0.5 | 0 | Special TR (SIR) on |
| 3 | 5.9, 1.8 | 170, 76.7 | 0.5 | 0.5 | High velocity, low temp. |
| 4 | 5.9, 1.8 | 181, 82.8 | 0 | 0.5 | Conventional TR on |
| 5 | 5.9, 1.8 | Low | 0.5 | 0.5 | High velocity, low temp. |
| 6 | 5.9, 1.8 | 181, 82.8 | Full | Full | Sneakage effects |
| 7 | 5.9, 1.8 | 181, 82.8 | 0.2 | 0.2 | High velocity, lower current density |
| 8 | 4.6, 1.4 | 156, 68.9 | 0.5 | 0.5 | Medium vel., low temp. |
| 9 | 4.6, 1.4 | 170, 76.7 | 0.5 | 0.5 | Medium vel., high temp. |
| 10 | 3.3, 1.0 | 170, 76.7 | 0.5 | 0.5 | Low vel., high temp. |
| 11 | 3.3, 1.0 | 156, 68.9 | 0.5 | 0.5 | Low vel., low temp. |
| 12 | 3.3, 1.0 | 142, 61.1 | 0.5 | 0.5 | Low vel., close to dew pt. |

*Treatment time was 0.69 seconds per field at 7.13 ft/s (2.17 m/s).
**Controlled using water sprays at wet ESP inlet. The average inlet gas temperature during the tests was 278° F. (136.7° C.).

Inlet opacity readings on the wet ESP ducting were taken for each run in order to estimate particulate concentration. Opacity meter readings were checked against particulate readings from gas sampling performed for runs 1, 2, 3 and 5. Acidic gas sampling was performed for runs 3, 4, 5, 9, 10 and 12.

The particulate sample was extracted from the duct isokinetically through a stainless steel nozzle and probe onto a pre-weighed glass fiber filter. The sample was taken at a series of points across the duct. Each point represented an equal area of duct. The isokinetic rate and volumetric flow rate were monitored by an S-type pitot tube attached to the probe.

(2) Was a function of current density, with higher collection for higher current density (from 0.2 $mA/m^2$ to 0.5 $mA/m^2$).

(3) Was a function of residence time in the wet field, due both to the number of energized fields as well as flue gas velocity.

Table 15 illustrates the effect of residence time in the wet ESP field. As the treatment time in the wet field increases, the average particulate collection efficiency also increases. The improvement in particulate collection efficiency rises more slowly beyond a treatment time of about 2.5 seconds, for which the average efficiency is 94%.

TABLE 13

Particulate Collection Efficiency of Wet ESP

| Run No. | Inlet opacity (%) | Outlet Gas Temperature* (° F., ° C.) | Inlet particulate content mg/actual $m^3$ | Inlet particulate content mg/normal $m^3$ | Outlet particulate content mg/normal $m^3$, wet | Particulate removal efficiency (%) |
|---|---|---|---|---|---|---|
| 1 | 1.88 | 253, 123 | 47.6 | 69 | 5.05 | 92.68 |
| 2 | 1.61 | 259, 126 | 32.9 | 59.5 | 8.95 | 84.95*** |
| 3 | 2.28 | 244, 118 | 55.1 | 82.8 | 4.93 | 94.04 |
| 4** | 2.3 | | 58.3 | 83.9 | 7.4 | 91.18 |
| 5 | 2.75 | 252, 122 | 76.6 | 101.1 | 4.93 | 95.12 |
| 6** | 3.03 | 252, 122 | 77.1 | 111.6 | 4.93 | 95.58 |
| 7** | 4 | 252, 122 | 102.3 | 148 | 12.79 | 91.36 |
| 8** | 4.05 | 252, 122 | 103.6 | 149.9 | 19.45 | 87.03 |
| 9** | 2.36 | 252, 122 | 59.9 | 86.6 | 4.93 | 94.31 |
| 10** | 4.16 | 252, 122 | 106.5 | 154.1 | 7.4 | 95.2 |
| 11** | 4.35 | 252, 122 | 111.5 | 161.3 | 7.4 | 95.41 |
| 12** | 4.25 | 252, 122 | 108.8 | 157.5 | 4.93 | 96.87 |

**Particulate content of inlet gas measured indirectly using opacity reading in inlet duct to wet ESP.
***Using an experimental TR set (Sm unit).

To summarize, the wet ESP performance for particulate removal was:

(1) Not significantly affected by changes in flue gas temperature in the test range evaluated.

(2) Was a function of current density, with higher collection for higher current density (from 0.2 $mA/m^2$ to 0.5 $mA/m^2$).

(3) Was a function of residence time in the wet field, due both to the number of energized fields as well as flue gas velocity.

TABLE 14

Particulate Concentrations in Flue Gas from Sampling Tests

| Run No. | Inlet (lb/$10^6$ Btu, g/MJ) | Outlet (lb/$10^6$ Btu, g/MJ) |
|---|---|---|
| 1 | 0.029, 0.0125 | 0.00430, 0.00185 |
| 2 | 0.041, 0.0176 | 0.00763, 0.00328 |
| 3 | 0.067, 0.0288 | 0.00491, 0.00211 |
| 4 | Not measured | 0.00674, 0.00290 |
| 5 | 0.095, 0.0408 | 0.00337, 0.00145 |
| 6 | Not measured | 0.00455, 0.00196 |
| 7 | Not measured | 0.01089, 0.00468 |
| 8 | Not measured | 0.01658, 0.00713 |
| 9 | Not measured | 0.00397, 0.00171 |
| 10 | Not measured | 0.00566, 0.00243 |
| 11 | Not measured | 0.00569, 0.00245 |
| 12 | Not measured | 0-00492, 0.00212 |

Table 15 illustrates the effect of residence time in the wet ESP field. As the treatment time in the wet field increases, the average particulate collection efficiency also increases. The improvement in particulate collection efficiency rises more slowly beyond a treatment time of about 1.7 seconds, for which the average efficiency is about 94%.

TABLE 15

Particulate Collection Efficiency as a Function at Residence Time in the Wet ESP

| Residence Time in Wet ESP (seconds) | Run Numbers | Average Particulate Collection Efficiency % |
|---|---|---|
| 0.83 | 2,4 | 88.1 |
| 1.66 | 1.3,5,6,7 | 94.4 |
| 2.14 | 9 | 94.3 |
| 2.98 | 10,11,12 | 95.8 |

Gas sampling showed some removal of the acidic gases $SO_2$ HF and HCl. The results of the tests are summarized in Table 16. Overall, hydrogen fluoride was better collected than both $SO_2$ and HCL, with an efficiency of 45%. The average collection efficiency for $SO_2$ was about 16%. The efficiency for hydrogen chloride was about 35%. These efficiencies should be treated only as upper bounds on gas removal because their variability is so large. Removal of acid gases might possibly be improved by increasing the pH of the sprayed water.

TABLE 16

Acid Gas Collection Efficiency of Wet ESP

| Run No. | Inlet $SO_2$ | Outlet $SO_2$ | Efficiency (%) | Inlet HCl | Outlet HCl | Efficiency (%) | Inlet HF | Outlet HF | Efficiency (%) |
|---|---|---|---|---|---|---|---|---|---|
| 3 | | | | 30.8 | 27.2 | 11.7 | 0.039 | 0.018 | 53.8 |
| 4 | 618.4 | 543.0 | 12.2 | 67.6 | 43.0 | 36.4 | 0.033 | 0.014 | 57.6 |
| 5 | 352.1 | 306.0 | 13.1 | | | | | | |
| 9 | | | | | | | 0.011 | 0.008 | 27.3 |
| 10 | 651.1 | 471.0 | 27.7 | 58.8 | 24.7 | 57.9 | 0.042 | 0.013 | 69.0 |
| 12 | 475.5 | 409.0 | 10.6 | | | | 0.011 | 0.009 | 18.2 |
| | | | Average = 15.9% | | | Average = 35.3% | | | Average = 45.2% |

*All gas concentrations are in mg/l.

The foregoing descriptions of specific embodiments of the present invention are presented for purposes of illustration and description. They are not intended to be exhaustive or to limit the invention to the precise forms disclosed, obviously many modifications and variations are possible in view of the above teachings. The embodiments were chosen and described in order to best explain the principles of the invention and its practical applications, to thereby enable others skilled in the art to best utilize the invention and various embodiments with various modifications as are suited to the particular use contemplated. It is intended that the scope of the invention be defined by the following claims and their equivalents.

What is claimed is:

1. An apparatus for decreasing the concentration of contaminants present in a flue gas stream emitted by a fossil-fuel fired boiler, comprising:

a wet electrostatic precipitator (ESP) field disposed in a combusted fossil-fuel flue gas stream path downstream of a dry ESP field;

at least one cooling nozzle disposed upstream of said wet ESP field in said combusted fossil-fuel flue gas stream path;

a temperature sensor disposed in said combusted fossil-fuel flue gas stream path; and a flue gas temperature control valve disposed between a water source and said at least one cooling nozzle, wherein said temperature sensor and said flue gas temperature control valve are configured to control a flow of water through said cooling nozzle to control a temperature of a flue gas stream downstream of said at least one cooling nozzle.

2. The apparatus of claim 1, further comprising:

a chamber housing said wet ESP field, and having a flue gas inlet and a flue gas outlet;

at least one wash nozzle positioned adjacent said wet ESP field; and a wet hopper positioned substantially under said wet ESP field, wherein said wet ESP field comprises at least one collection plate.

3. The apparatus of claim 2, further comprising:

a plurality of cooling nozzles; and a plurality of wash nozzles.

4. The apparatus of claim 2, further comprising a pH adjustment module fluidly coupled between said wet hopper and a pond.

5. The apparatus of claim 4, further comprising a J-drain fluidly coupled between said wet hopper and said pH adjustment module.

6. The apparatus of claim 2, further comprising a filter fluidly coupled between said water source and said wash nozzle.

7. The apparatus of claim 2, further comprising a treatment processor fluidly coupled between said wet hopper and said wash nozzle.

8. The apparatus of claim 7, wherein said treatment processor comprises a clarifier.

9. The apparatus of claim 7, wherein said treatment processor comprises a mixer fluidly coupled between said wet hopper and said clarifier.

10. The apparatus of claim 7, further comprising a J-drain fluidly coupled between said wet hopper and said treatment processor.

11. The apparatus of claim 7, further comprising a make-up water source also fluidly coupled to said wash nozzle.

12. The apparatus of claim 1, wherein said dry ESP comprises:

at least one collection plate; and a dry hopper positioned substantially under said collection plate.

13. The apparatus of claim 1, further comprising another dry ESP field positioned along said flue gas stream path between said fossil-fuel fired boiler and said wet ESP.

14. The apparatus of claim 1, wherein said wet ESP field is a final ESP in a series of ESPs positioned in said combusted fossil-fuel flue gas stream path, before a flue gas stream outlet.

15. A method of decreasing the concentration of contaminants present in a flue gas stream emitted by a fossil-fuel fired boiler, said method comprising:

electrostatically collecting contaminants from a combusted fossil-fuel flue gas stream on dry and wet electrostatic precipitator (ESP) conductors, where said wet ESP conductor is disposed downstream of said dry ESP conductor;

measuring a temperature of said combusted fossil-fuel flue gas stream to obtain a measured temperature;

adjusting said temperature of said combusted fossil-fuel flue gas stream downstream of said dry ESP conductor and upstream of said wet ESP conductor, based on said measured temperature;

shaking said dry ESP conductor to remove contaminants collected thereon; and washing said wet ESP conductor to remove contaminants collected thereon.

16. The method of claim 15, further comprising the step, prior to said washing step, of spraying water into said flue gas stream before it is collected on said wet ESP conductor.

17. The method of claim 15, wherein said washing step comprises spraying water onto said wet ESP conductors to remove particulates collected thereon.

18. The method of claim 17 further comprising collecting a solution of said contaminants removed from said washing step and said water in a wet hopper.

19. The method of claim 18, further comprising draining said solution to a J-drain.

20. The method of claim 18, further comprising treating said solution.

21. The method of claim 20, wherein said treating step comprises adjusting the pH level of said solution.

22. The method of claim 20, further comprising conveying said solution to a pond.

23. The method of claim 20, wherein said treating step comprises separating said solution into a clarified solution and a slurry.

24. The method of claim 23, further comprising conveying said slurry to a pond.

25. The method of claim 24, further comprising adding make-up water to said clarified solution prior to said washing step.

26. The method of claim 25, further comprising filtering said make-up water prior to said adding step.

27. The method of claim 15, further comprising the initial step of acquiring water from a water source.

28. The method of claim 27, wherein said acquiring step further comprises filtering said water prior to said spraying step.

29. The method of claim 20, wherein said treating further comprises a start-up and steady state operation.

30. The method of claim 29, wherein said treating step during said start-up operation comprises mixing said solution with soda ash slurry or caustic.

31. The method of claim 29, wherein said treating during said steady state operation comprises mixing said solution with a substance selected from a group consisting of: a polymer, a ferric sulfate, a caustic, lime slurry, and any combination of the aforementioned substances.

32. The method of claim 21, wherein said pH level of said solution is adjusted to about 12.

33. The method of claim 29, wherein said solution during said steady state operation comprises concentrations selected from a group consisting of:

suspended solids ranging from 2 to 16 mg/L;

calcium levels ranging from 1.15 to 816 mg/L;

magnesium levels ranging from 0 to 5.21 mg/L;

silicon levels ranging from 0 to 8.58 mg/L; and any combination of the aforementioned concentrations.

34. The method of claim 15, wherein said adjusting further comprises lowering said temperature of said combusted fossil-fuel flue gas stream.

35. The method of claim 34, wherein said lowering further comprises lowering said temperature of said combusted fossil-fuel flue gas stream by 20 to 80 degrees Fahrenheit above the moisture saturation temperature of said combusted fossil-fuel flue gas stream.

36. The method of claim 34, wherein said lowering further comprises:

controlling a flue gas temperature control valve connected between a water source and a cooling nozzle; and spraying water from said cooling nozzle.

37. The method of claim 15, wherein said adjusting further comprises slowing said combusted fossil-fuel flue gas stream.

38. An apparatus for decreasing the concentration of contaminants present in a flue gas stream emitted by a fossil-fuel fired boiler, comprising:

a dry electrostatic precipitator positioned in a combusted fossil-fuel flue gas stream path;

a wet electrostatic precipitator positioned downstream of said dry electrostatic precipitator, wherein said wet electrostatic precipitator further comprises:

a chamber;

at least one collection plate disposed within said chamber; and a wash nozzle disposed within said chamber;

a cooling nozzle disposed upstream of said at least one collection plate in said combusted fossil-fuel flue gas stream path;

a temperature sensor in said combusted fossil-fuel flue gas stream path; and a flue gas temperature control valve positioned between a water source and said cooling nozzle, wherein said temperature sensor and said flue gas temperature control valve are configured to control a flow of water through said cooling nozzle to control a temperature of a flue gas stream downstream of said at least one cooling nozzle.

* * * * *